US010851645B2

(12) United States Patent
Mandava et al.

(10) Patent No.: US 10,851,645 B2
(45) Date of Patent: Dec. 1, 2020

(54) METHOD AND SYSTEM FOR DETECTING AND ADDRESSING A KICK WHILE DRILLING

(71) Applicant: Nabors Drilling Technologies USA, Inc., Houston, TX (US)

(72) Inventors: Chakrapani Mandava, Houston, TX (US); Andrew Armstrong, The Woodlands, TX (US); Michael Lockridge, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 237 days.

(21) Appl. No.: 15/593,425

(22) Filed: May 12, 2017

(65) Prior Publication Data

US 2018/0328159 A1 Nov. 15, 2018

(51) Int. Cl.

| | |
|---|---|
| ***E21B 47/10*** | (2012.01) |
| ***E21B 44/00*** | (2006.01) |
| ***E21B 33/06*** | (2006.01) |
| ***E21B 21/08*** | (2006.01) |
| ***E21B 3/02*** | (2006.01) |
| ***E21B 19/00*** | (2006.01) |

(52) U.S. Cl.

CPC ..... *E21B 47/10* (2013.01)

(58) Field of Classification Search

CPC ..... E21B 44/00; E21B 33/06; E21B 21/08; E21B 47/10; E21B 3/02; E21B 19/008

See application file for complete search history.

(56) References Cited

U.S. PATENT DOCUMENTS

| | | | | |
|---|---|---|---|---|
| 5,952,569 | A | 9/1999 | Jervis et al. | |
| 6,233,498 | B1 * | 5/2001 | King | E21B 44/00 700/174 |
| 6,768,106 | B2 | 7/2004 | Gzara et al. | |
| 6,820,702 | B2 | 11/2004 | Niedermayr et al. | |
| 7,128,167 | B2 * | 10/2006 | Dunlop | G06N 7/005 175/24 |
| 9,019,118 | B2 * | 4/2015 | Milne | E21B 47/10 340/853.3 |
| 2003/0057366 | A1 * | 3/2003 | Gzara | E21B 44/00 250/269.3 |
| 2015/0134258 | A1 * | 5/2015 | Luppens | E21B 49/003 702/11 |
| 2016/0237810 | A1 | 8/2016 | Beaman, Jr. et al. | |

* cited by examiner

*Primary Examiner* — Giovanna Wright
*Assistant Examiner* — Manuel C Portocarrero
(74) *Attorney, Agent, or Firm* — Haynes and Boone, LLP

(57) ABSTRACT

Systems, devices, and methods for detecting and addressing a kick on a drilling rig are provided. A controller on the drilling rig may receive measurements from one or more sensor systems on the drilling rig and determine a severity index value corresponding to the likelihood of a kick. If the severity index level is determined to reach a specified threshold, an operator may be prompted to perform a flow check and/or activate a blow-out preventer.

20 Claims, 9 Drawing Sheets

METHOD AND SYSTEM FOR DETECTING AND ADDRESSING A KICK WHILE DRILLING

TECHNICAL FIELD

The present disclosure is directed to systems, devices, and methods for automatically detecting and addressing a kick on a drilling apparatus. More specifically, the present disclosure is directed to systems, devices, and methods for detecting a kick, performing a flow check, and actuating a blow-out preventer during a drilling operation.

BACKGROUND OF THE DISCLOSURE

During a drilling operation, drillers must be careful to detect and avoid kicks. The term "kick" may refer to a sudden influx of fluid into a wellbore which may spill out and may have serious consequences. Generally, kicks are caused by higher pressures in the fluids in the formations around the wellbore than in the wellbore itself. Kicks may emerge because mud weight is too low, leading to insufficient hydrostatic pressure exerted on formations by the fluid column. Kicks may also occur because of motion of the drill string or casing within the wellbore which may cause dynamic and fluid pressure effects and effectively lower pressure within the wellbore. In any case, kicks may cause substantial damage to equipment and endanger workers in the drilling operation.

Existing kick detection systems are usually based on visual observations by the driller and systems that rely on flow rate measurements or downhole measurements. Generally, a driller is required to carefully monitor equipment and watch for flow changes in various drilling systems. If such a spike is detected, the driller must take action by manually operating various systems to avoid worsening of kick conditions. Furthermore, existing kick detection systems require careful analysis of many systems on the drilling rig which may be a complicated and time consuming process for an operator or expensive to bring on the additional flow rate sensors. Therefore, a need exists for an efficient, automated kick detection system that might alleviate at least some of the responsibilities of the operator utilizing existing equipment on the rig.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 4B is graph showing a method of detecting a kick after pumps are turned on.

DETAILED DESCRIPTION

Figure 1:
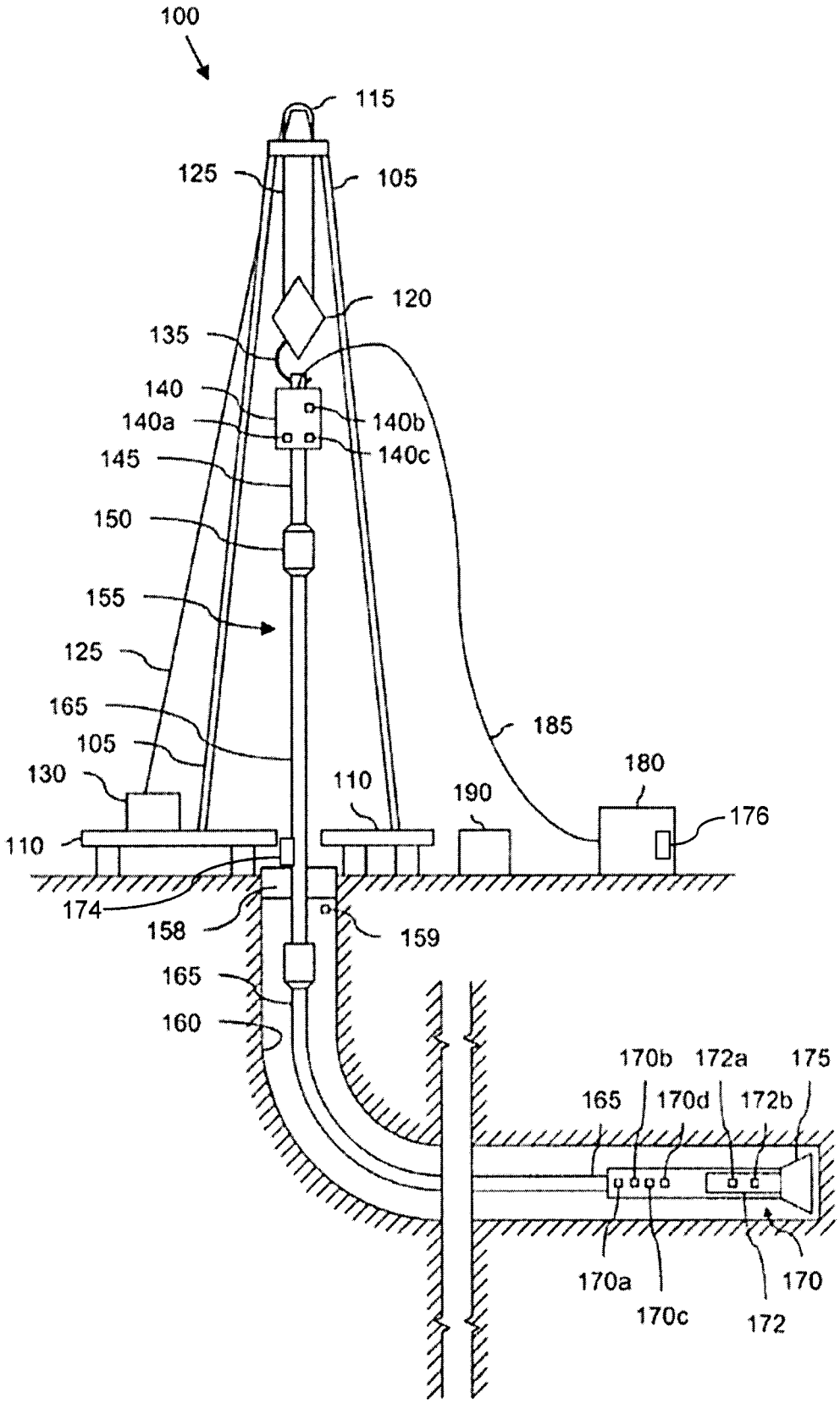
FIG. 1 is a schematic of an exemplary drilling apparatus according to one or more aspects of the present disclosure.

It is to be understood that the following disclosure provides many different implementations, or examples, for implementing different features of various implementations. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various implementations and/or configurations discussed.

The systems and methods disclosed herein provide a kick detection system for a drilling rig. In particular, the present disclosure describes a kick detection system that may assess sensor readings on the drilling rig to determine a severity index. In some implementations, the severity index is an indication of the confidence that a kick is occurring on the drilling rig. The severity index may be measured as a value from 0 to 100. If the severity index is determined to be over a certain threshold, the kick detection system is configured to prompt an operator to perform a flow check. If the flow check confirms that a kick is occurring, the kick detection system may prompt an operator to actuate a blow-out preventer (BOP), or in the case of a fully automated rig, automatically close the BOP. Some of the systems and implementations described in this present disclosure represent an improvement over existing systems because they may detect a kick and take automated action on behalf of the driller. Furthermore, some of the systems and implementations described in this present disclosure utilize existing sensors on the drilling rig without requiring new sensor systems to be added for the sole purpose of detecting a kick.

Referring to FIG. 1, illustrated is a schematic view of an apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others.

Apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to drawworks 130, which is configured to reel in and out the drilling line 125 to cause the traveling block 120 to be lowered and raised relative to the rig floor 110. The other end of the drilling line 125, known as a dead line anchor, is anchored to a fixed position, possibly near the drawworks 130 or elsewhere on the rig.

A hook 135 is attached to the bottom of the traveling block 120. A top drive 140 is suspended from the hook 135. A quill 145 extending from the top drive 140 is attached to a saver sub 150, which is attached to a drill string 155 suspended within a wellbore 160. Alternatively, the quill 145 may be attached to the drill string 155 directly. The term "quill" as used herein is not limited to a component which directly extends from the top drive, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill."

The drill string 155 includes interconnected sections of drill pipe 165, a bottom hole assembly (BHA) 170, and a drill bit 175. The BHA 170 may include stabilizers, drill collars, and/or measurement-while-drilling (MWD), among other components. For the purpose of slide drilling the drill string may include a down hole motor with a bent housing or other bend component, operable to create an off-center departure of the bit from the center line of the wellbore. The direction of this departure in a plane normal to the wellbore is referred to as the toolface angle or toolface. The drill bit 175 may be connected to the bottom of the BHA 170 or otherwise attached to the drill string 155. One or more pumps 180 may deliver drilling fluid to the drill string 155 through a hose or other conduit, which may be connected to the top drive 140. In some implementations, the one or more pumps 180 include a mud pump.

The down hole MWD instruments may be configured for the evaluation of physical properties such as pressure, temperature, gamma radiation count, torque, weight-on-bit (WOB), vibration, inclination, azimuth, toolface orientation in three-dimensional space, and/or other down hole parameters. These measurements may be made down hole, stored in memory, such as solid-state memory, for some period of time, and downloaded from the instrument(s) when at the surface and/or transmitted in real-time to the surface. Data transmission methods may include, for example, digitally encoding data and transmitting the encoded data to the surface, possibly as pressure pulses in the drilling fluid or mud system, acoustic transmission through the drill string 155, electronic transmission through or wired pipe, transmission as electromagnetic pulses, among other methods. The MWD sensors or detectors and/or other portions of the BHA 170 may have the ability to store measurements for later retrieval via wireline and/or when the BHA 170 is tripped out of the wellbore 160.

In an exemplary implementation, the apparatus 100 may also include a rotating control device (RCD) (also known as a rotating head) or blow-out preventer (BOP) 158 that may assist when the wellbore 160 is being drilled utilizing under-balanced or managed-pressure drilling methods. The apparatus 100 may also include a surface casing annular pressure sensor 159 configured to detect the pressure in an annulus defined between, for example, the wellbore 160 (or casing therein) and the drill string 155.

In the exemplary implementation depicted in FIG. 1, the top drive 140 is utilized to impart rotary motion to the drill string 155. However, aspects of the present disclosure are also applicable or readily adaptable to implementations utilizing other drive systems, such as a power swivel, a rotary table, a coiled tubing unit, a down hole motor, and/or a conventional rotary rig, among others.

The apparatus 100 also includes a controller 190 configured to control or assist in the control of one or more components of the apparatus 100. For example, the controller 190 may be configured to transmit operational control signals to the drawworks 130, the top drive 140, the BHA 170 and/or the one or more pumps 180. In some implementations, the controller 190 may be a stand-alone component. The controller 190 may be disposed in any location on the apparatus 100. Depending on the implementation, the controller 190 may be installed near the mast 105 and/or other components of the apparatus 100. In an exemplary implementation, the controller 190 includes one or more systems located in a control room in communication with the apparatus 100, such as the general purpose shelter often referred to as the "doghouse" serving as a combination tool shed, office, communications center, and general meeting place. In other implementations, the controller 190 is disposed remotely from the drilling rig. The controller 190 may be configured to transmit the operational control signals to the drawworks 130, the top drive 140, the BHA 170, and/or the one or more pumps 180 via wired or wireless transmission devices which, for the sake of clarity, are not depicted in FIG. 1.

The controller 190 is also configured to receive electronic signals via wired or wireless transmission devices (also not shown in FIG. 1) from a variety of sensors included in the apparatus 100, where each sensor is configured to detect an operational characteristic or parameter. In some implementations, the controller includes an electronic data recorder (EDR) or is in communication with an EDR. Depending on the implementation, the apparatus 100 may include a down hole annular pressure sensor **170*a* coupled to or otherwise associated with the BHA 170. The down hole annular pressure sensor 170*a* may be configured to detect a pressure value or range in an annulus shaped region defined between the external surface of the BHA 170 and the internal diameter of the wellbore 160, which may also be referred to as the casing pressure, down hole casing pressure, MWD casing pressure, or down hole annular pressure. Measurements from the down hole annular pressure sensor 170*a*** may include both static annular pressure (pumps off) and active annular pressure (pumps on).

Figure 2:
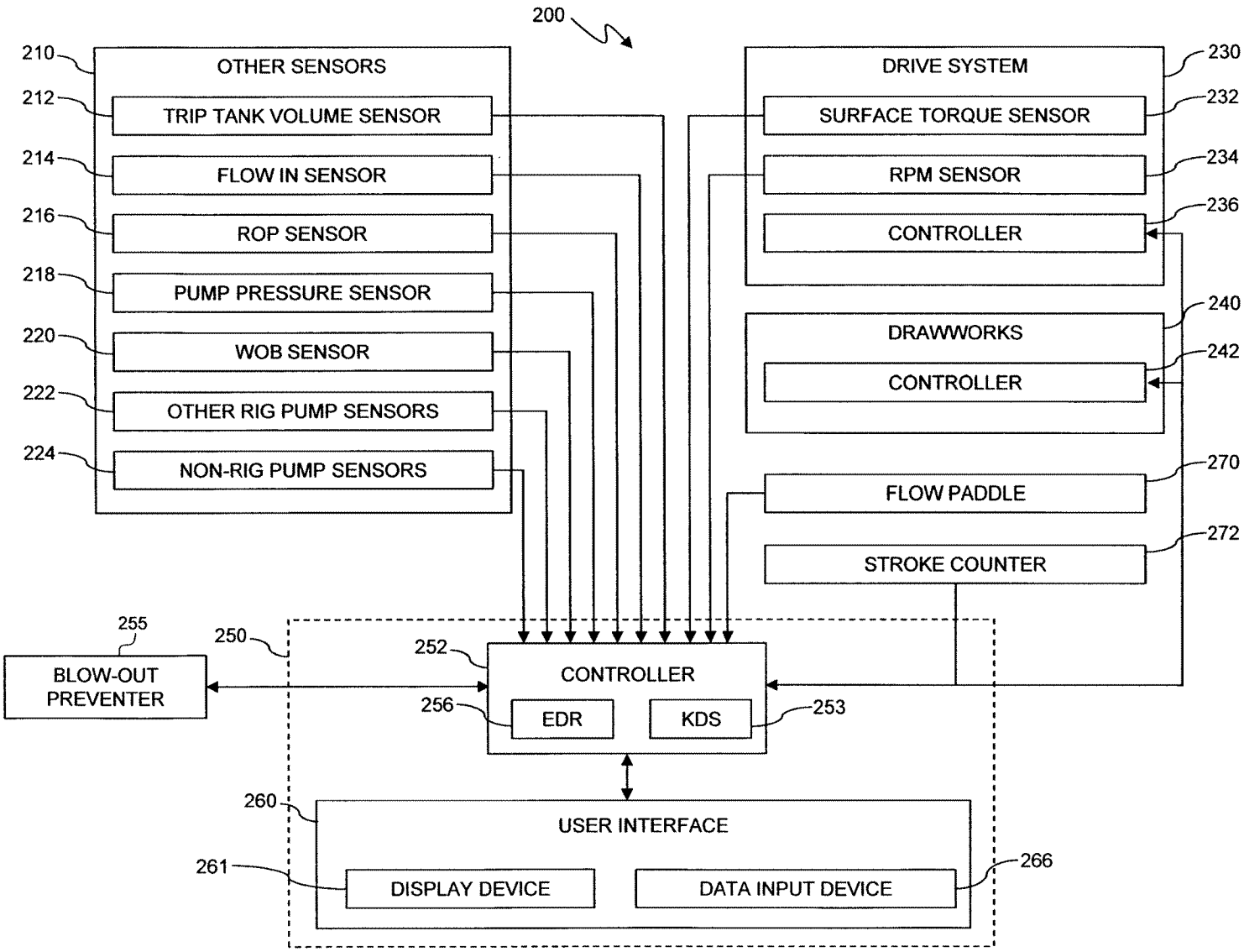
FIG. 2 is a schematic of an exemplary sensor and control system according to one or more aspects of the present disclosure.

The controller 190 may include a kick detection system 253 (as shown in FIG. 2). The kick detection system may be part of the controller 190 or may be a separate component in communication with the controller 190. For the purpose of clarity, the controller 190 and the kick detection system may be referred to interchangeably. In some implementations, the controller 190 may be configured to control the operation of various systems on the apparatus 100 in relation to the kick detection system. For example, in response to a sensor system detecting a high likelihood of a kick, the controller 190 may perform a flow check. In some implementations, a flow check is performed by actuating the drawworks 130, shutting down the one or more pumps 180 (including mud pumps), stopping the rotation of the top drive 140, and examining a flow back profile of the well. The controller 190 may perform all of these actions automatically or prompt an operator to perform these actions. If the flow check shows that a kick is occurring, the controller 190 may prompt an operator to actuate a blow-out preventer (BOP) 158. In some implementations, if the one or more pumps 180 are off when the sensor system detects a kick, the controller 190 may prompt an operator to actuate the BOP 158 without a flow check. The controller 190 may also automatically perform the flow check and/or actuate the BOP 158 without input from an operator. The controller 190 may be configured to communicate prompts, status information, sensor readings, and other information to an operator, for example, on a user interface such as user interface 260 of FIG. 2. The controller 190 may communicate via wired or wireless communication channels.

It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

The apparatus 100 may additionally or alternatively include a shock/vibration sensor 170*b* that is configured to detect shock and/or vibration in the BHA 170. The apparatus 100 may additionally or alternatively include a mud motor pressure sensor 172*a* that may be configured to detect a pressure differential value or range across one or more motors 172 of the BHA 170. The one or more motors 172 may each be or include a positive displacement drilling motor that uses hydraulic power of the drilling fluid to drive the drill bit 175, also known as a mud motor. One or more torque sensors 172*b* may also be included in the BHA 170 for sending data to the controller 190 that is indicative of the torque applied to the drill bit 175 by the one or more motors 172.

The apparatus 100 may additionally or alternatively include a toolface sensor 170*c* configured to detect the current toolface orientation. In some implementations, the toolface sensor 170*c* may be or include a conventional or future-developed magnetic toolface sensor which detects toolface orientation relative to magnetic north. Alternatively or additionally, the toolface sensor 170*c* may be or include a conventional or future-developed gravity toolface sensor which detects toolface orientation relative to the Earth's gravitational field. The toolface sensor 170*c* may also, or alternatively, be or include a conventional or future-developed gyro sensor. The apparatus 100 may additionally or alternatively include a weight on bit (WOB) sensor 170*d* integral to the BHA 170 and configured to detect WOB at or near the BHA 170.

The apparatus 100 may additionally or alternatively include a flow paddle 174 which may be configured to measure the height of fluid flowing through the return line or a percentage that the paddle is open or closed. The flow paddle 174 may be attached to the return flow line which may serve as the main flow line from one or more BOPs 158 to the mud pits.

The apparatus 100 may additionally or alternatively include a stroke counter 176 which may be configured to measure the number of strokes and stroke rate of the one or more pumps 180 and may be used in conjunction with other mud pump parameters to determine the flow rate of fluid entering the wellbore. In some implementations, the stroke counter 176 is disposed on the one or more pumps 180. In some implementations, one or both of the flow paddle 174 and the stroke counter 176 may be used by the kick detection system to determine the likelihood of a kick, as will be discussed in more detail below.

The apparatus 100 may additionally or alternatively include a torque sensor 140*a* coupled to or otherwise associated with the top drive 140. The torque sensor 140*a* may alternatively be located in or associated with the BHA 170. The torque sensor 140*a* may be configured to detect a value or range of the torsion of the quill 145 and/or the drill string 155 (e.g., in response to operational forces acting on the drill string). The top drive 140 may additionally or alternatively include or otherwise be associated with a speed sensor 140*b* configured to detect a value or range of the rotational speed of the quill 145.

The top drive 140, drawworks 130, crown or traveling block, drilling line or dead line anchor may additionally or alternatively include or otherwise be associated with a WOB sensor 140*c* (WOB calculated from a hook load sensor that may be based on active and static hook load) (e.g., one or more sensors installed somewhere in the load path mechanisms to detect and calculate WOB, which may vary from rig to rig) different from the WOB sensor 170*d*. The WOB sensor 140*c* may be configured to detect a WOB value or range, where such detection may be performed at the top drive 140, drawworks 130, or other component of the apparatus 100.

The detection performed by the sensors described herein may be performed once, continuously, periodically, and/or at random intervals. The detection may be manually triggered by an operator or other person accessing a human-machine interface (HMI), or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection devices may include one or more interfaces which may be local at the well/rig site or located at another, remote location with a network link to the system.

Referring to FIG. 2, illustrated is a block diagram of a sensor and control system 200 according to one or more aspects of the present disclosure. The sensor and control system 200 includes a user interface 260, a drive system 230, a drawworks 240, other sensors 210, and a controller 252. The sensor and control system 200 may also include a flow paddle 270 and a stroke counter 272. The sensor and control system 200 may be implemented within the environment and/or apparatus shown in FIG. 1, the drive system 230 may be substantially similar to the top drive 140 shown in FIG. 1, the drawworks 240 may be substantially similar to the drawworks 130 shown in FIG. 1, and the controller 252 may be substantially similar to the controller 190 shown in FIG. 1.

The user interface 260 and the controller 252 may be discrete components that are interconnected via wired or wireless devices. Alternatively, the user interface 260 and the controller 252 may be integral components of a single system or controller 252, as indicated by the dashed lines in FIG. 2. In some implementations, the controller 252 includes an electronic data recorder (EDR) 256. In particular, the EDR 256 may be a component of the controller 252. In other implementations, the EDR 256 is a separate component disposed separately and apart from the controller 252, but may be in communication with the controller 252. The EDR 256 may log values of various sensors around the rig. The EDR 256 may also transmit the information to one or more remote locations, such as a third party or another drilling rig. The EDR 256 may perform calculations on data collected by the controller and feed results of those calculations back to the controller 252. In some implementations, any of the components of the controller 252, EDR 256, kick detection system 253, user interface 260, display device 261, and data input device 266 may be included in a control unit 250, which is shown as a dotted line to indicate that various components may be included together or separately.

The sensor and control system 200 may also include a kick detection system 253 as shown in FIG. 2. In the implementation shown, the kick detection system 253 is a module, a subcontroller, or other component forming a part of the controller 252. Other implementations include the kick detection system 253 in communication with, but disposed separately and apart from the controller 252. In some implementations, the kick detection system 253 may be part of the EDR 256. In particular, the kick detection system 253 and the EDR 256 may be combined into a single device if a separate controller 190 does not manipulate data received by various sensors. In this case, the kick detection system 253 may communicate with the controller 190 to send a kick severity index so that the controller 190 can perform a flow check and close BOPs if necessary, as discussed below. Although the kick detection system 253 may be a separate component from the controller 252 in some implementations, for the sake of clarity, the kick detection system 253 will be discussed as a part of the controller 252 below. The kick detection system 253 may be connected to the sensor systems of the sensor and control system 200 and may be configured to calculate a severity index and detect a kick.

The user interface 260 may include a data input device 266 which may be used for data input of measurements, sensor readings, set points, limits, previously recorded data, and other input data. In particular, the user interface 260 may be used to assign and measure data points to produce a severity index for indicating the probability of a kick occurring on the drilling rig. In some implementations, the user interface 260 may send data to the EDR 256 and/or receive a severity index from the EDR 256. The data input device 266 may include a keypad, voice-recognition apparatus, dial, button, switch, slide selector, toggle, joystick, mouse, data base and/or other conventional or future-developed data input device. The data input device 266 may support data input from local and/or remote locations. Alternatively, or additionally, the data input device 266 may include devices for user-selection of predetermined toolface set point values or ranges, such as via one or more drop-down menus. In general, the data input device 266 and/or other components within the scope of the present disclosure support operation and/or monitoring from stations on the rig site as well as one or more remote locations with a communications link to the system, network, local area network (LAN), wide area network (WAN), Internet, satellite-link, and/or radio, among other devices.

The user interface 260 may also include a display device 261 arranged to present sensor results, prompts to a controller, severity index values and calculations, drilling rig visualizations, as well as other information. The user interface 260 may visually present information to the user in visual form, such as textual, graphic, video, or other form, or may present information to the user in audio or other sensory form. In some implementations, the display device 261 is a computer monitor, an LCD or LED display, tablet, touch screen, or other display device. The user interface 260 may include one or more selectable icons or buttons to allow an operator to access information and control various systems of the drilling rig. In some implementations, the display device 261 is configured to present information related to a severity index indicating a kick to an operator.

In some implementations, the severity index is a value (i.e., a number from 0 to 100) with a higher number corresponding to a higher likelihood that a kick will occur on the drilling rig. In some implementations, the severity index is measured according to Equipment Condition Monitoring standards (ECM) on a scale of 1 to 4. In other implementations, the severity index is a simple "yes" or "no" condition. For example, the kick detection system 253 may receive some indication of a kick from a sensor system, such as a previously determined indication (i.e., a certain amount of flow from the wellbore). At this point, the kick detection system may determine that "yes," a kick is occurring and may prompt a flow check and/or close the BOP without comparing a severity index value to a threshold. The severity index may also include a time component. For example, a severity index of 80 which lasts for 30 seconds or more may indicate that a kick is very likely to occur, while a severity index of 80 which lasts for under 5 seconds may not represent a serious kick threat. In some implementations, a severity index threshold may be input into the controller 252 by a user or generated by the controller. This severity index threshold may represent the level at which action will be taken on the drilling rig. For example, if a severity index value is measured during a drilling operation which meets or exceeds the severity index threshold, actions may be automatically taken, such as flagging data channels, automatically stopping equipment, sending prompts to an operator, performing checks on equipment, and sending alerts to remote monitoring centers. As discussed above, the severity index threshold may include a time component. In some implementations, a severity index threshold of 80 out of 100 may be chosen with a time from about 30 seconds. This severity index threshold may vary according to the operation because kicks may be more likely during particular drilling operations.

The severity index and/or the severity index threshold may be displayed graphically on the display device 261, such as on a chart or by using various colors, patterns, symbols, images, figures, or blinking patterns. In some implementations, the severity index and/or the severity index threshold may be displayed on a dial, a light bar, or other visual indicator. In other implementations, the severity index may be displayed as a numerical value or other digital value. In some implementations, the value of the severity index may correspond to a color scheme so as to allow the operator to quickly assess risk levels associated with the severity index. For example, if the severity index is measured as a value from 0 to 100, a value of 10 may be displayed with a green color while a value of 80 may be displayed with a red color. Prompts and alerts related to the severity index may also be displayed with various colors, shapes, and patterns on the display device 261.

In some implementations, the sensor and control system 200 may include a number of sensors. Although a specific number of sensors are shown in FIG. 2, the sensor and control system 200 may include more or fewer sensors than those disclosed. Furthermore, some implementations of the kick detection system may include additional sensors not specifically described herein.

Still with reference to FIG. 2, the sensor and control system 200 may include other sensors 210 including one or more of a trip tank volume sensor 212, a flow in sensor 214, a rate of penetration (ROP) sensor 216, a pump pressure sensor 218, a weight on bit (WOB) sensor 220, other rig pump sensors 222, and non-rig pump sensors 224.

The trip tank volume sensor 212 may be a sensor connected to the trip tank of the rig and configured to measure the volume of the trip tank. The flow in sensor 214 may be a sensor to measure the volume of fluid flowing into the wellbore. In some implementations, the flow in sensor is the stroke counter 272, while in other implementations, the flow in sensor is another type of sensor. The ROP sensor 216 may measure changes in the block position when a drill bit is on bottom. The pump pressure sensor 218 may be a sensor on one or more pumps of the drilling rig (such as pumps 180 shown in FIG. 1), and may measure the volume of the pumps. The WOB sensor 220 may be configured to detect a value or range of values for WOB at or near the drill bit. Other rig pump sensors 222 may be configured to measure the volume of pumps besides the mud pumps (such as cellar pumps). Non-rig pump sensors 224 may be configured to measure the volume fluid from pumps that are not permanently associated with the drilling rig. For example, third party systems such as cementing unit or other pieces of equipment that are not part of a standard rig may include pumps. The non-rig pump sensors 224 may measure the volume of fluid entering the wellbore from these non-rig systems. In some implementations, the fluid entering the wellbore from non-rig systems is added to the fluid pumped into the wellbore from pumps on the drilling rig, and the total volume is referred to as "flow in." Any of the other sensors 210 may be configured to send measurements to the controller 252 or EDR 256 via wired or wireless transmission.

The drawworks 240 may include a controller 242 and/or other devices for controlling feed-out and/or feed-in of a drilling line (such as the drilling line 125 shown in FIG. 1). Such control may include rotational control of the drawworks (in versus out) to control the height or position of the hook, and may also include control of the rate the hook ascends or descends.

The drive system 230 may be the same as the top drive 140 in FIG. 1 and may include a surface torque sensor 232 that is configured to detect a value or range of the reactive torsion of the quill or drill string, much the same as the torque sensor 140*a* shown in FIG. 1. The drive system 230 also includes a RPM sensor 234 that is configured to detect a value or range of the rotational position of the quill, such as relative to true north or another stationary reference. In some implementations, the RPM sensor 234 is a quill position sensor. The surface torsion and quill position data detected via the surface torque sensor 232 and the RPM sensor 234, respectively, may be sent via electronic signal to the controller 252 via wired or wireless transmission. The drive system 230 also includes a controller 236 and/or other devices for controlling the rotational position, speed, and direction of the quill or other drill string component coupled to the drive system 230 (such as the quill 145 shown in FIG. 1).

The sensor and control system 200 may also include a flow paddle 270, which may also correspond to the flow paddle 174 in FIG. 1. In some implementations, the flow paddle 270 may be configured to measure the height of fluid in a conduit or how open or closed the paddle is. These measurements may allow determination of the quantity of fluids being applied to the wellbore or flowing out of the wellbore. The flow paddle 270 may be configured to communicate position measurements to the controller 252 via wired or wireless transmission.

The sensor and control system 200 may also include a stroke counter 272, which may be the same stroke counter 176 in FIG. 1. In some implementations, the stroke counter 272 may be configured to measure the number of strokes and stroke rate of one or more pumps, such as the one or more pumps 180. The stroke counter 272 may be configured to communicate stroke measurements to the controller 252 via wired or wireless transmission.

The sensor and control system 200 may also include a blow-out preventer (BOP) 255, which may be the same as the BOP 158 of FIG. 1. In some implementations, the BOP 255 may be controlled by the controller 252. The status of the BOP 255 may also be monitored by the controller 252. In some implementations, the BOP 255 may be closed if the controller 252, the kick detection system 253, and/or or a remote operating center detect a kick or the likelihood of a kick.

In some implementations, the kick detection system 253 of the controller 252 may be configured to detect a kick by evaluating sensed or detected parameters received from the sensors described herein, which are located about the apparatus 100, as shown and described in FIGS. 1 and 2. In some implementations, the controller 252 may detect a kick by using the detected data to identify an increase in return flow (for example from the flow paddle 270) from the wellbore that does not correlate with a change in other explainable parameters of the drilling rig. For example, when an increase in return flow (for example from the flow paddle 270) corresponds in time with a rise in the stroke rate of the one or more pumps, a spike in the rate of penetration, a drop in pump pressure, or a drop in the weight on the drill bit, the controller may determine that a kick is not present. In some implementations, the controller may detect a kick by analyzing one or more data channels of a sensor to detect an increase in volume. If more than one channel shows an increase in volume, a kick may be occurring. An increase in return flow from the wellbore that does not correlate with other changing parameters may also be indicative of a kick.

The controller 252 may be configured to receive information or data relating to one or more of the above-described parameters from the user interface 260, the drawworks 240, the drive system 230, the flow paddle 270, other sensor systems 210, and/or the stroke counter 272. The controller may then utilize such parameters to continuously, periodically, or otherwise determine a severity index for the sensor and control system 200. In some implementations, the parameters are transmitted to the controller 252 by one or more data channels. In some implementations, each data channel may carry data or information relating to a particular sensor. In other implementations, a data channel may carry data or information relating to a sensor system comprised of a plurality of sensors. Each data channel may be analyzed by the kick detection system independently to determine a severity index.

In some implementations, the controller 252 may be configured to detect an increase in return flow (for example from the flow paddle 270) of the main pumps and a drop in the pump pressure while the rig pumps are running. This case will be discussed in greater detail with reference to FIG. 5.

The controller 252 may be configured to detect an increase in the return flow without an increase in the stroke rate of the main pumps during drilling and circulating. If such a case is observed, the controller 252 may raise the severity index according to how many data channels exhibit parameters indicative of an increase or decrease. The controller 252 may also raise the severity index if the return flow (for example from flow paddle 270) rises by a large amount. This case will be discussed in greater detail in reference to FIGS. 4 and 5.

In some implementations, the controller 252 may be configured to estimate the total volume of fluid that issues from the wellbore as soon as the pumps are turned off during activities such as, but not limited to, drilling connections and flow checks. This volume may be estimated by measuring the return flow rate (for example from flow paddle 270) and comparing this to return flow rates (from the flow paddle 270) recorded during one or more previous drilling connections or flow checks. In some implementations, the controller 252 may increase the severity index if the standard deviations of the flow rate (from the flow paddle 270) measurement are above a mean measurement based on previously recorded flow rate measurements. The severity index may also be increased if the controller 252 detects increases in the return flow (from the flow paddle 270) in the absence of comparison information. This case will be discussed in greater detail in reference to FIGS. 4A and 4B.

In some implementations, the controller 252 may be configured to estimate the return flow rate (from the flow paddle 270) while the rig pumps are turned off during tripping connections and compare that to the mean and standard deviation return flow rates recorded during previous tripping connections. The controller 252 may raise the severity index as the number of standard deviations of the current flow rate is above the mean of previous flow rates (from the flow paddle 270). The severity index may also be increased if the controller 252 detects increase in the return flow (from the flow paddle 270) if there are no previous tripping connections to compare to. This situation will be discussed in greater detail in reference to FIG. 7.

In some implementations, the controller 252 may be configured to detect increases in return flow (from a change in trip tank volume) above normal levels related to the displacement of a pipe while the pumps are off and tubulars are being lowered into the well, tripping in and/or running casing and/or tubing. The severity index may be raised if the controller 252 determines that the return flow (from a change in trip tank volume) is greater than expected. The severity index may be lowered if the controller 252 determines that the return flow (from a change in trip tank volume) is at normal levels or lower than expected. This case will be discussed in greater detail in reference to FIG. 8. For example, the controller 252 may provide one or more signals to a blow-out preventer 255 on the sensor and control system 200 to deploy in the event of a kick.

Figure 3:
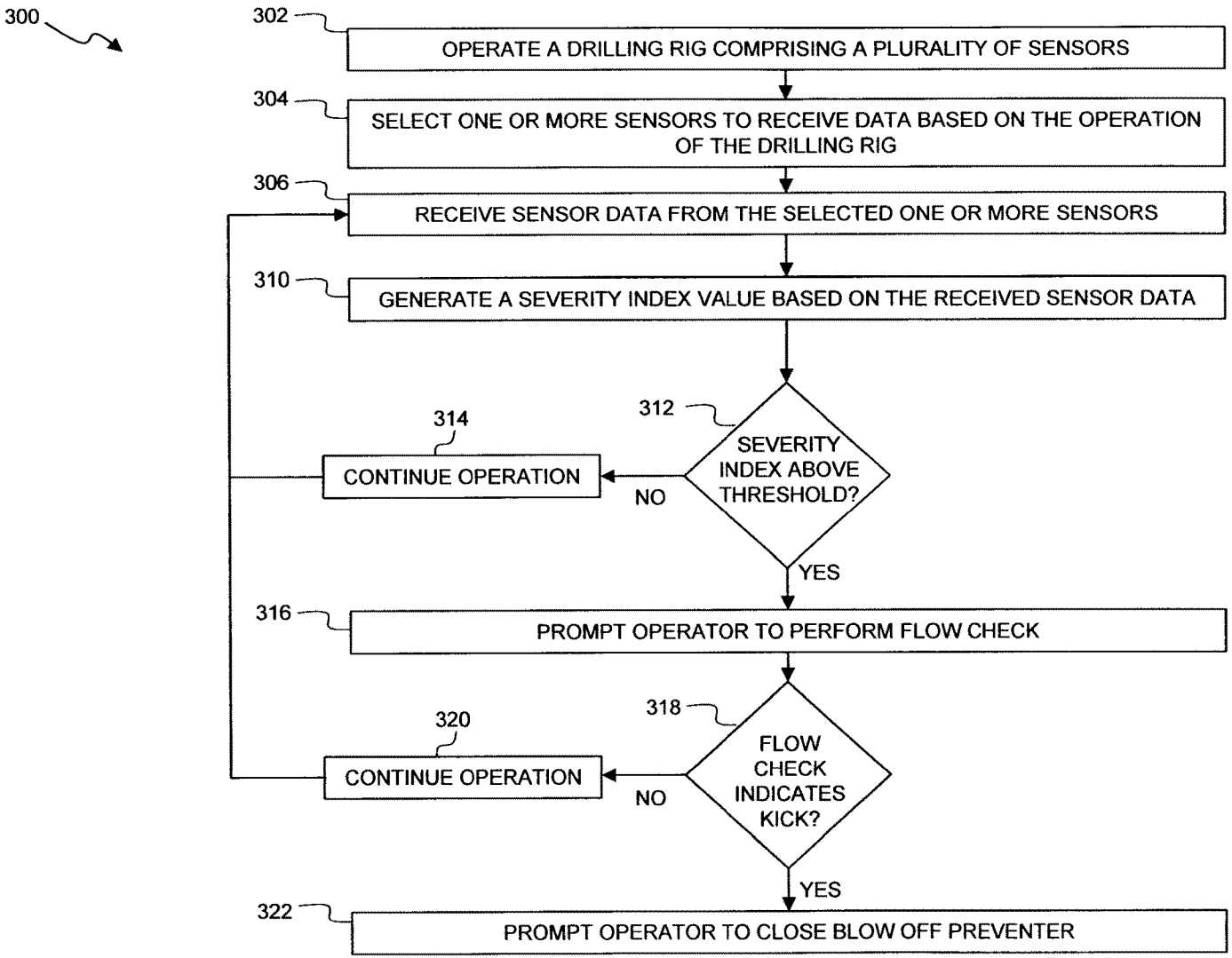
FIG. 3 is a flow chart diagram of a method of automatically detecting a kick according to one or more aspects of the present disclosure.

FIG. 3 is a flow chart showing a method 300 of detecting a kick on a drilling rig utilizing the sensor and control system 200. It is understood that additional steps may be provided before, during, and after the steps of method 300, and that some of the steps described may be replaced or eliminated for other implementations of the method 300. In particular, any of the control systems disclosed herein, including those of FIGS. 1 and 2 may be used to carry out the method 300.

At step 302, the method 300 may include operating a drilling rig comprising a plurality of sensors. The drilling rig may be the apparatus 100 of FIG. 1 and the plurality of sensors may include any of the sensors and/or controllers depicted in the sensor and control system 200 shown in FIG. 2.

At step 304, the method 300 may include selecting one or more sensors of the drilling rig to receive data based on the operation of the drilling rig with a controller, such as controller 190 of FIG. 1 or controller 252 of FIG. 2. The data may relate to one or more parameters of the drilling rig. In some implementations, the specific sensors are selected depending upon the drilling task being performed by the drilling rig. For example, when the drilling task is pumping fluid into the wellbore during drilling, the controller may monitor the stroke counter or a volumetric "flow in" derived from mud pump specifications and measurements from stroke counters on single or multiple mud pumps. In some implementations, some sensors may constantly be monitored or selected by the system irrespective of the drilling task. The controller may monitor any number of sensors during step 304. FIGS. 4-8 describe the process of detecting kicks during different drilling tasks of the drilling rig.

At step 306, the controller may receive sensor data from the selected one or more sensors. This sensor data may be indicative of the one or more measured parameters. In some implementations, the sensor data is received and analyzed by a controller such as controller 190 of FIG. 1 or controller 252 of FIG. 2.

At step 310, the method 300 may include generating, with the controller, a severity index value based on the received sensor data. In some implementations, the severity index value is calculated using sensor data from a single sensor system, such as a stroke counter or flow paddle. In other implementations, the severity index value is calculated by analyzing data from multiple sensors and systems. The data from each sensor or system may be weighted differently depending on its role in predicting or measuring a kick. For example, a sharp increase in the return flow (as measured by the flow paddle) may be assigned a severity index score of 40 or more while an increase in circulation pressure may be assigned a severity index of 20 or 10. The severity index values for various systems may be aggregated by the controller over a period of time. Additionally or alternatively, the severity index values may be aggregated by the controller during one or more operations on the drilling rig, such as during a circulation operation.

Furthermore, the severity index may include "flags" or "flagging a channel." One purpose of flags or flagging channels is to be able to quantify the kick severity index during drilling and circulating operations. The flagging channels used are rate of penetration (ROP), WOB, and pump pressure. When a rig takes a kick, the ROP usually increases by a significant amount, the WOB usually decreases by a significant amount, and the pump pressure usually decreases by a significant amount. One or more of these channels are flagged if the earlier conditions are met, which will increase the kick index by a fixed amount per channel. The kick index will only be increased by flagged channels if a rise in return flow measured by the flow paddle was detected without an increase in the total flow in (from the rig pump as well as any non-rig pumps). In some implementations, there are other channels that could be flagged as potential signs of kicks, but the example of method 300 uses only the above three channels. In some implementations, the flags may refer to an identifier that is assigned by the controller to a data channel or drilling system to indicate that a kick may occur. In some implementations, a flagged data channel is automatically assigned a baseline severity index value (such as 20). In other implementations, a flagged channel signals to the operator to closely watch the channel to determine if a kick is probable. Flags may be automatically assigned or removed depending on the operation of the kick detection system and the presence of various factors related to the severity index threshold.

At step 312, the method 300 may include determining whether the severity index value is above a threshold input with the controller. In some implementations, step 312 includes the controller making a simple comparison of the severity index value determined by the system with the severity index threshold.

In some implementations, the severity index threshold may be a value corresponding to the likelihood or severity of a kick on the drilling rig. The severity index threshold may be generated by receiving an input from an operator indicative of the threshold, may include retrieving the severity index threshold from memory, or may include calculating a severity index threshold for the specific drilling task being performed. In some implementations, the severity index threshold is a value that is determined by analyzing sensor data obtained during previous kicks at the same or different wellbores, in similar or different conditions. Analyzing such data may enable users or even a controller in real time to assign a threshold "score" by the system. In some implementations, the severity index threshold is 80 on a scale of 0 to 100. In some implementations, the severity index threshold may also include a time component above which the severity index must reside. For example, in some implementations, the severity index threshold may have a preset value and may have a preset time period that must be met before the controller will indicate that the severity index threshold is exceeded. In one example, the severity index threshold may be set at a value of 80, with a time threshold setting of 30 seconds. Accordingly, to exceed the severity index threshold, the controller would detect a severity index greater than 80 for greater than 30 seconds. The time period of 30 seconds is exemplary, and both longer and shorter times are contemplated. Furthermore, the severity index threshold of 80 is also exemplary. In other implementations, the severity index is 60 or 100 on a scale of 0 to 100. Different severity index threshold values may be chosen based on the type of operation on the drilling rig, the parameters being measured, the underground formation being drilled, or other factors. The system may be configured to automatically take various actions in the event that the severity threshold is reached, such as flagging systems, stopping the operation of systems, and sending prompts to an operator or sending alerts to remote monitoring locations.

If the severity index value is determined to be below the severity index threshold, the operation may continue in step 314, including continuing to receive sensor data such as in step 306. If the severity index value is determined to be above the severity index threshold, the method 300 may include a step 316 to prompt an operator to perform a flow check. In some implementations, the operator receives a prompt on a display device such as display device 261 of FIG. 2. The operator may then manually perform a flow check to determine whether a kick is likely or actively occurring. In some implementations, the operator is given an option to "accept" or "decline" the prompt to perform the flow check. If the operator "accepts" the prompt, the system may automatically perform a flow check. If the operator "declines" the prompt, the system may resume the operation or cancel the prompt. In other implementations, a flow check is automatically performed when a severity index value is measured over the severity index threshold. In this case, the operator or real time monitoring center may be informed of the performance of the flow check and any results of the flow check. The flow check may be performed by lifting bit off bottom if applicable, shutting down the pumps if applicable, stopping drill string rotation if applicable, raising the drill string until a tool joint (for example, a drill pipe connection) is just above the drill floor and clear of pipe rams if present in the BOP stack, and examining a flow back profile of the well. In some implementations, if the pumps are off when the severity index value is determined to be above the severity index threshold, the controller may prompt an operator to actuate the BOP without a flow check. The controller may automatically perform the flow check and/or actuate the BOP without input from an operator.

At step 318, the method 300 may include determining, with the controller, whether the flow check returned data indicating a kick. This determination may be based on a rate or volume of fluid issuing from the wellbore. In some implementations, this rate or volume of fluid may be estimated, as in step 404 of method 400 as discussed below. In some implementations, step 318 may be determined automatically by the controller or by a remote monitoring/command center. In other implementations, the determination of step 318 may be performed by an operator comparing the results of the flow check to existing drilling rig data. If the flow check does not indicate a kick, the method 300 may continue at step 320 by continuing the operation. The operation may also repeat and continue at step 306.

If the flow check indicates a kick at step 318, the method 300 may include a step 322 to prompt the operator or remote monitoring/command center to close a blow-out preventer on the drilling rig. In some implementations, this blow-out preventer is the BOP 158 of FIG. 1 or the BOP 255 of FIG. 2. Similarly to step 316, this step 322 may include a prompt with an "accept" or "decline" option. Alternatively, the step 322 may include a simple notification to the operator to close the blow-out preventer. In other implementations, step 322 may include automatically closing the blow-out preventer and sending a prompt the operator that the blow-out preventer has been closed. In cases of fully automated rigs (where no driller is present on location), steps 316 and 322 may be executed without intervention from an operator but will send a notification to a real time operating/command center if applicable.

Figure 4A:
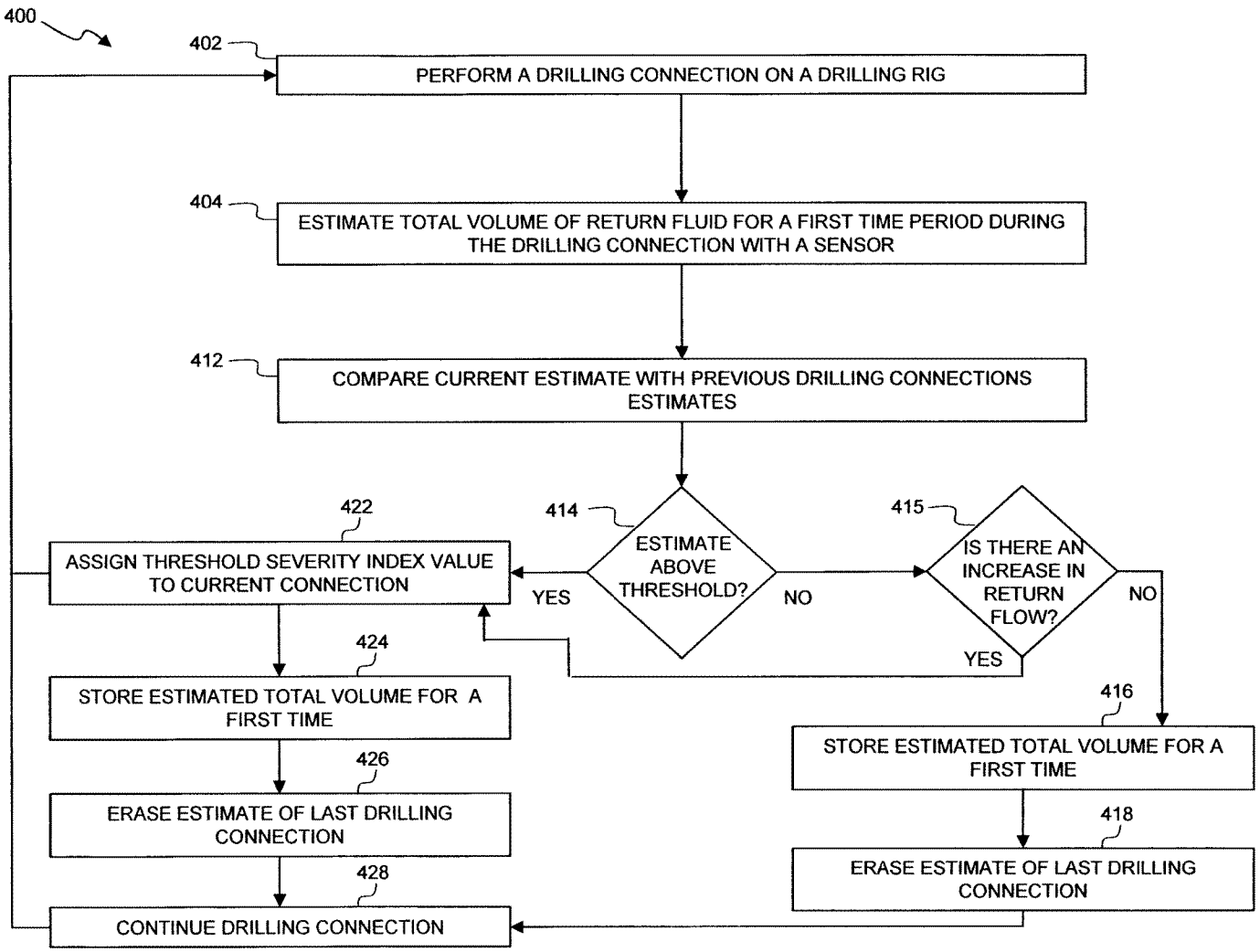
FIG. 4A is a flow chart diagram of a method of automatically detecting a kick during a drilling connection according to one or more aspects of the present disclosure.
Figure 5:
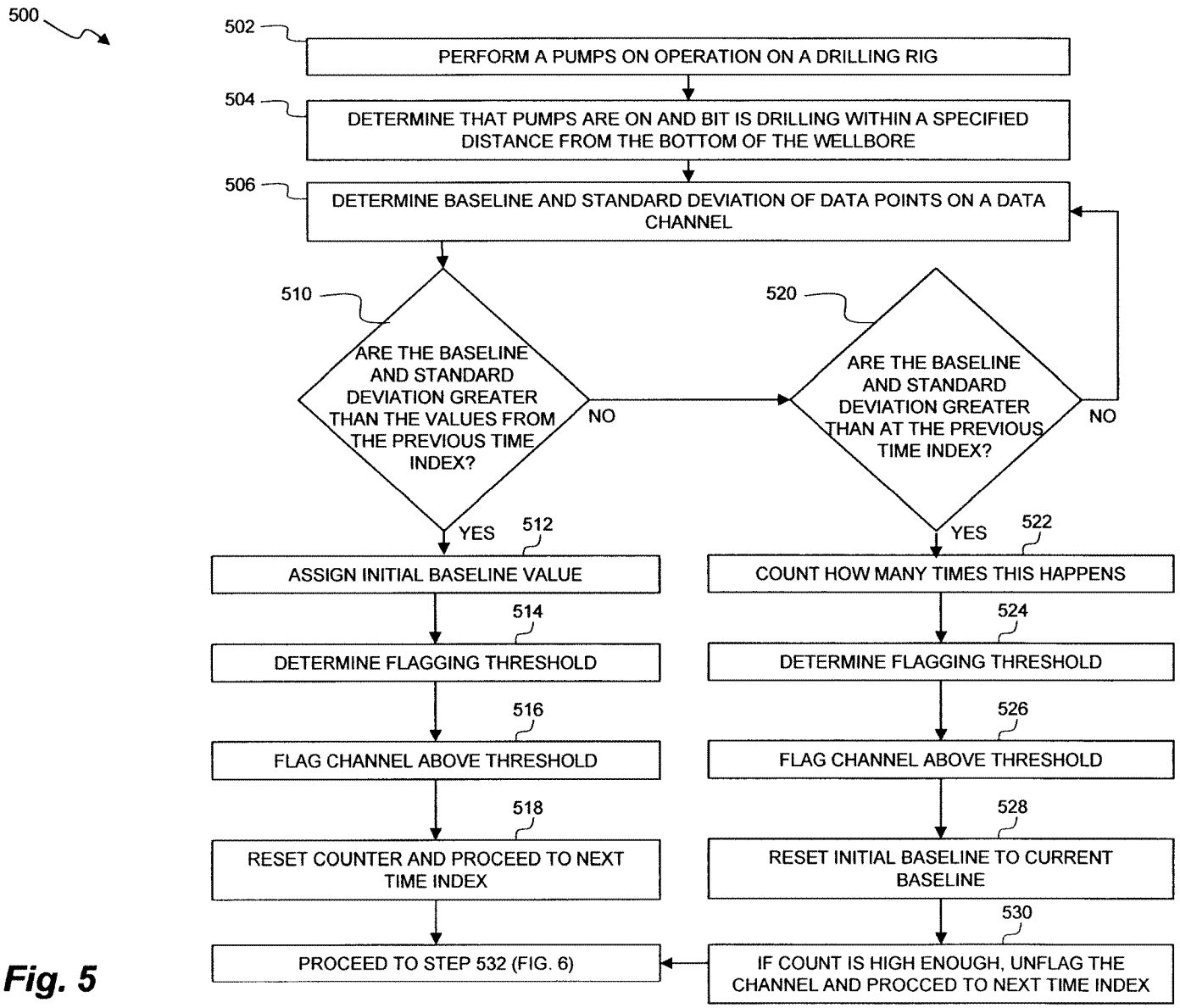
FIG. 5 is a flow chart diagram of a method of automatically detecting a kick during a pumps on operation according to one or more aspects of the present disclosure.
Figure 6:
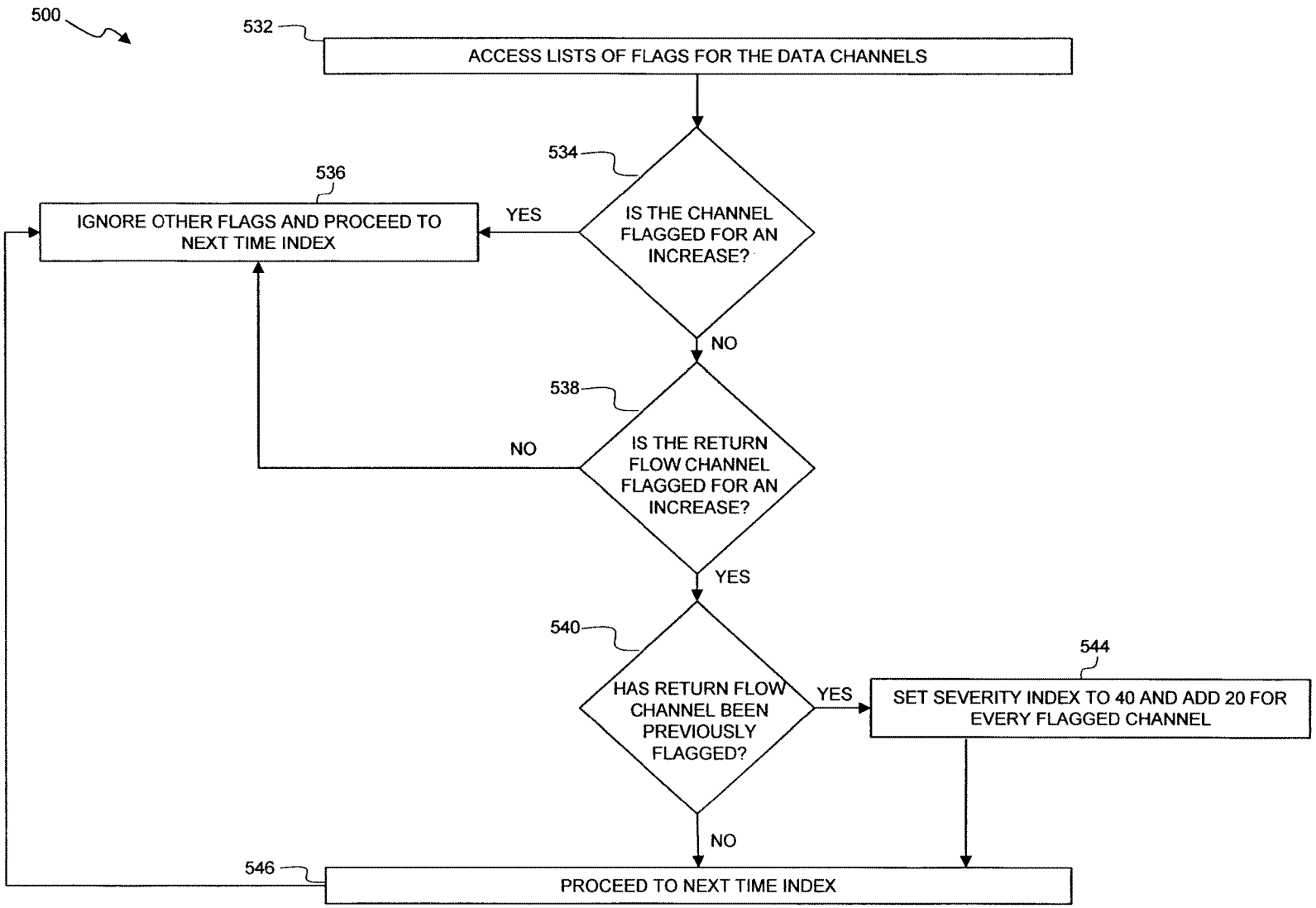
FIG. 6 is a continuation of the flow chart diagram of FIG. 5.
Figure 7:
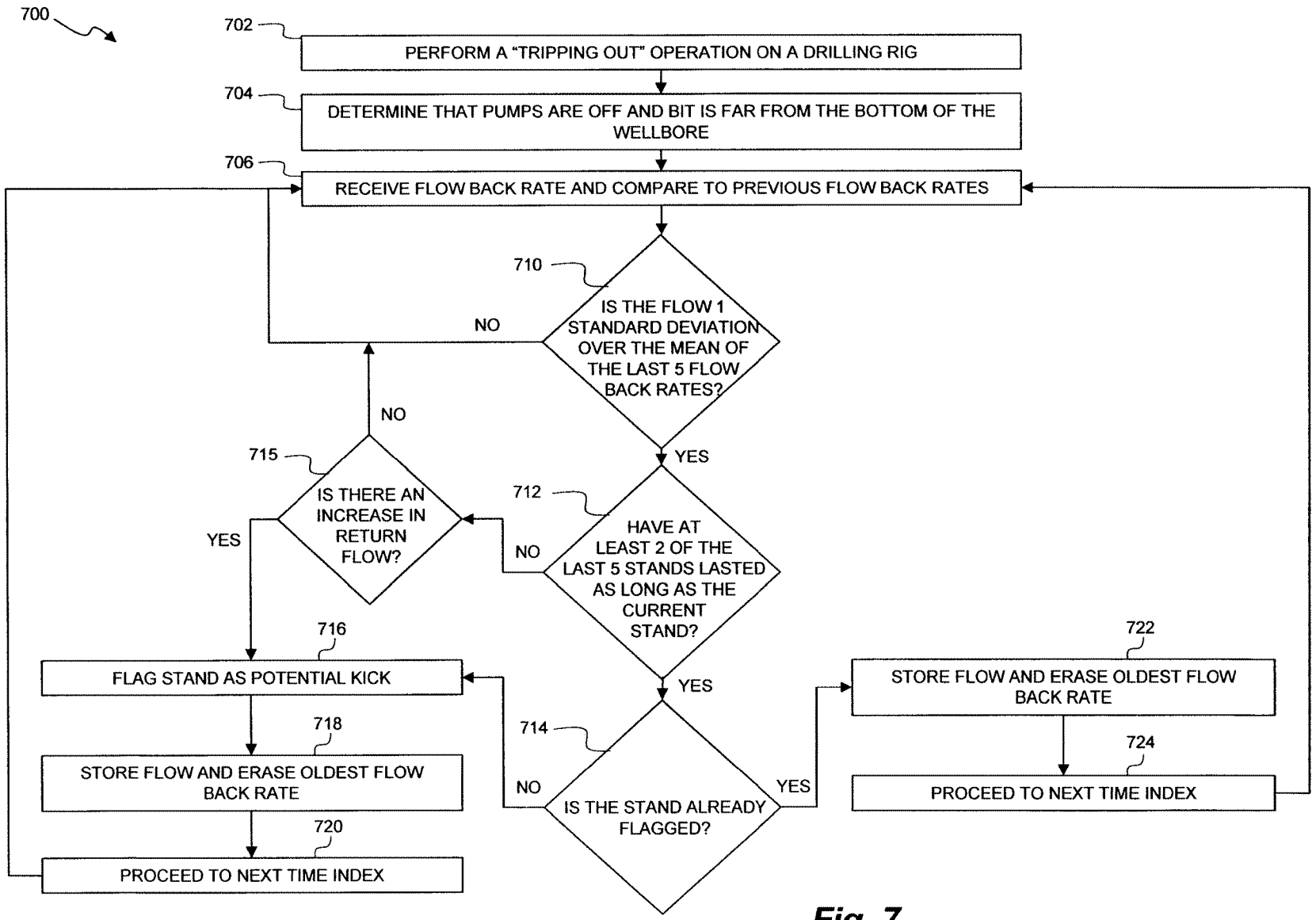
FIG. 7 is a flow chart diagram of a method of automatically detecting a kick during a "tripping out" operation according to one or more aspects of the present disclosure.
Figure 8:
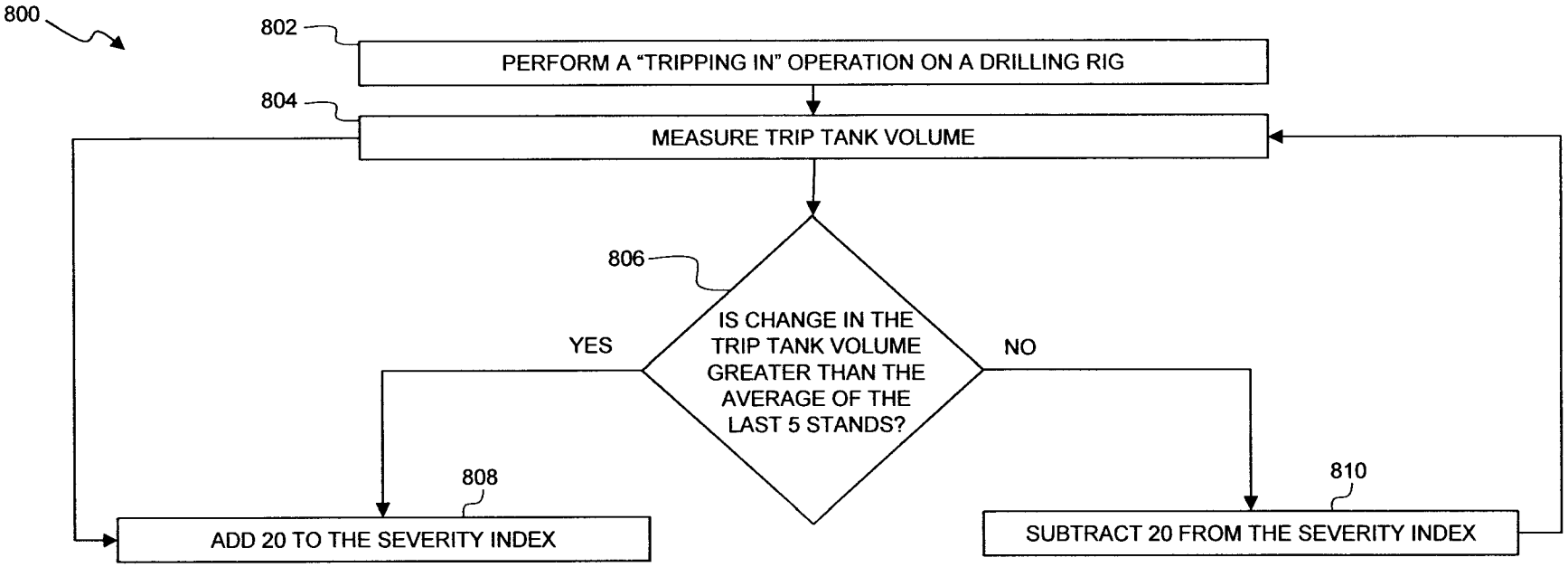
FIG. 8 is a flow chart diagram of a method of automatically detecting a kick during a "tripping in" operation according to one or more aspects of the present disclosure.

FIGS. 4A and 5-8 are flow charts depicting methods 400-800 of detecting a kick during various operations or drilling tasks of the drilling rig. The flow charts may provide details on how severity index values are calculated and what steps are taken depending on the outcome. In some implementations, the various operations depicted in the methods 400-800 may be applied to method 300. In particular, the methods 400-800 may be used to illustrate monitoring the one or more sensors in step 304 and the generation of the severity index based on the received sensor data in step 310. FIG. 4A shows a method of automatically detecting a kick right after the pumps (on the rig as well as any external pumps) are shut down until they are turned on again, except for where tripping in and tripping out activities are identified by the controller; FIGS. 5 and 6 show a method of automatically detecting a kick during a circulation operation while the pumps (on the rig as well as any external pumps) are turned on until they are turned off again (e.g., during drilling and circulating); FIG. 7 shows a method of automatically detecting a kick while tripping out and pumps (on the rig as well as any external pumps) are turned off; and FIG. 8 shows a method of automatically detecting a kick while tripping in and pumps (on the rig as well as any external pumps) are turned off. These drilling tasks are exemplary only, and the kick detection system may monitor for kicks during additional drilling tasks and during other operations of the drilling rig.

FIG. 4A is a flow chart showing a method 400 of detecting a kick when pumps are shut off until they are turned back on. In some implementations, these pumps include pumps on the rig as well as any external pumps. It is understood that additional steps may be provided before, during, and after the steps of method 400, and that some of the steps described may be replaced or eliminated for other implementations of the method 400. In particular, any of the control systems disclosed herein, including those of FIGS. 1 and 2 may be used to carry out the method 400.

At step 402, the method 400 may include performing a drilling connection on a drilling rig. This may be accomplished by advancing a BHA such as BHA 170 of FIG. 1 a sufficient distance to add a new pipe stand to the drill string, and then adding the new pipe stand to the drill string.

Figure 4B:
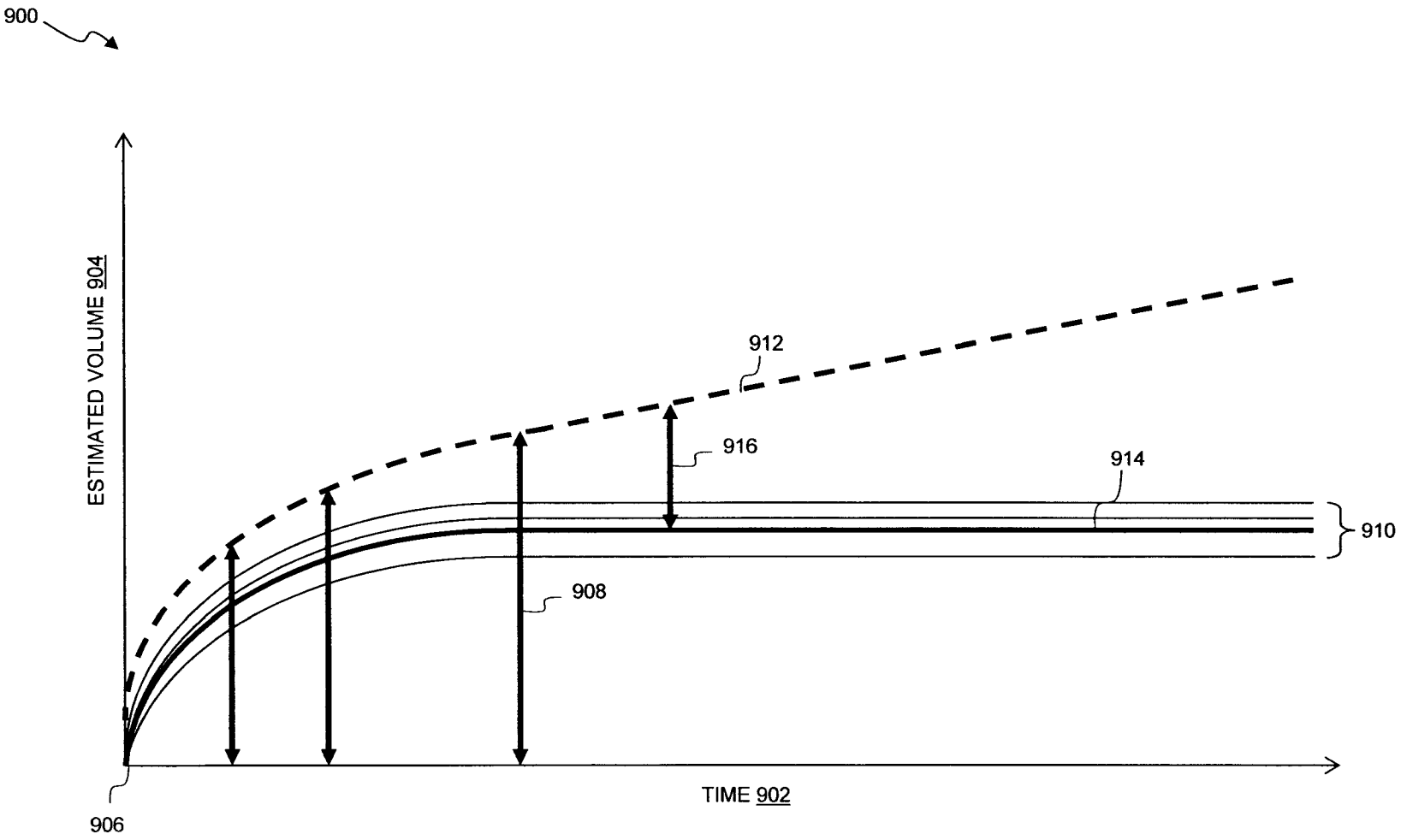

At step 404, the method 400 may include estimating, with a controller, a total volume of return fluid (for example using flow paddle 270 as shown in FIG. 2) for a first time period during the drilling connection with a sensor. In some implementations, the controller may be the controller 190 of FIG. 1 or controller 252 of FIG. 2. In some implementations, the first time period may represent the time required to complete the entire drilling connection or some portion of the connection. In other implementations, the first time period may be a time period shorter than the time required to complete the entire drilling connection. In some examples, the time period may be within a range of 15 and 45 seconds. The sensor may be a flow paddle. The volume may be estimated by measuring the flow rate over a period of time. The controller may then calculate the volume of return fluid based on the time and flow rate from the flow paddle. The pumps of the drilling rig may be turned off during step 404. Furthermore, the calculation may take into account a period of time for residual fluid in the lines to drain. Step 404 may also include storing the estimate of the volume in a memory. Any number of volume estimates may be stored in the memory. For example, a number of stored estimates from previous connections may be chosen to allow for enough data to be compared while still allowing the system to account for dynamic changes in the drilling operation due to changes in the formations around the operation, normal flow back profiles, and other changes. In some implementations, the controller has stored the prior five volume estimates. In other implementations, the controller has stored the prior four volume estimates. In some implementations, the controller stores all volume estimates. The system may also be configured to store a history of flow or a curve of flow from a given time period that corresponds with a volume estimate. For example, the system may be configured to store any of the exemplary curves 910, 912, 914, as shown in FIG. 4B below. Furthermore, the system may be configured to store the total time of a drilling connection and relate that time period to the total estimated volume. Since drilling connection time may have an impact in the return flow volume, this correlation may help an operator to determine if an unusually high return flow is present in the case of a kick. In some implementations, the estimate is stored by the controller 252, EDR 256, and/or kick detection system 253 as shown in FIG. 3.

At step 412, the controller compares the present estimated volume of step 404 to previous estimated volumes, which may be retrieved from the memory. This comparison may help an operator to determine the increase or decrease in volume of the return fluid over time. In some implementations, the average volume of each estimate is compared. Additionally or alternatively, the standard deviation of each volume is compared. The comparison of the estimated volume is also shown in reference to FIG. 4B as discussed below.

At step 414, the method 400 may include determining if the present estimate is above a threshold with the controller. In some implementations, the controller may retrieve the comparison threshold from memory, or an operator may input the comparison threshold into the controller. In some implementations the threshold is specific to the well being drilled. In other implementations, the comparison threshold is preset in the controller during master programming. In some implementations, the controller determines the comparison threshold. In such implementations, the comparison threshold may be determined by measuring the mean and standard deviation of the various previously obtained volume estimates. In some implementations, the means and standard deviations of the various volume measurements are compared as well as the drilling times of the connections for which the volumes were estimated.

In some implementations, the controller compares the present estimated volume of step 404 to the previous estimated volume of step 408 to determine if the present estimated volume is a) one standard deviation over the mean of the last five volume estimates and b) at least two of the last drilling connections (for which the volume was estimated) were as long in time as the present drilling connection. If the volume is not one standard deviation over the mean of the last five volume estimates, or only one of the last five drilling connections lasted as long as the current connection, or if the current drilling connection is already flagged, the method 400 may proceed to step 415.

At step 415, the controller may determine if there is an increase in return flow. If this is the case, the method 400 may proceed to step 422. If this is not the case, the method 400 may proceed to step 416.

At step 416, the estimated total volume is stored. After storing the estimated volume, the method 400 may proceed to step 418 where the volume estimate of the last previous time period is erased. Erasing and replacing the volume estimates may allow an operator to judge the likelihood of a kick as the drilling operation progresses. The determination of the likelihood of a kick occurring may be based on how many standard deviations the current volume is above the mean of the previous five (for example, other numbers are also possible) volumes in a pumps off to pumps on event. Although one standard deviation and the time periods of the last two drilling connections are used as examples herein, other implementations include a different deviation or a different number of time periods.

Going back to step 414, if the present volume is one standard deviation over the mean of the last five volume estimates at the current time and at least two of the last pumps off to pumps on events (for which the volume was estimated) were as long as the present pumps off to pumps on event, and the current pumps off to pumps on event is not already flagged, a severity index value is assigned to the pumps off to pumps on at step 422. As an example, a value of 20 is assigned to the severity index, although larger or smaller values may be assigned in other implementations. The severity index may start at, for example, three standard deviations for a threshold value, although other deviations may be used. In other implementations, other numbers of standard deviations are used in step 414, such as two or five.

At step 424, the estimated total volume is stored by the controller. After storing the estimated volume, the method 400 proceeds to step 426 where the volume estimate of the last pumps off to pumps on event is erased.

After erasing the estimate of the last pumps off to pumps on event in steps 426, the method 400 may proceed to step 428 where the pumps off to pumps on event is continued. In some implementations, the estimated total volume is stored in a temporary list in a memory which may be used to overwrite the oldest estimated volume on the list. In some implementations, erasing does not occur until a connection is completed.

In an exemplary implementation within the scope of the present disclosure, the method 400 repeats after step 428, such that method flow goes back to step 402 and begins again. Iteration of the method 400 may be utilized to update the severity index throughout a drilling operation.

FIG. 4B is graph 900 showing a method of detecting a kick during pumps off to pumps on events. In some implementations, pumps off to pumps on events are performed during a drilling operation on a drilling rig where pumps are turned on from an off position.

In some implementations, the graph 900 may illustrate aspects of step 412 as shown in FIG. 4A. In particular, graph 900 may illustrate the comparison of volume estimates on a drilling rig. Graph 900 represents information that may be gathered and compared by an EDR or kick detection system such as the EDR 256 or kick detection system 253 as shown in FIG. 2. Graph 900 shows the estimated volume of fluid entering a wellbore as compared to time when pumps (such as pumps 180 shown in FIG. 1) are turned on. The graph 900 includes an x-axis 902 representing time and a y-axis 904 representing an estimated volume of fluid. The origin 906 of graph 900 may represent a point where pumps are switched from off to on.

Volume estimates 908 may be taken at one or more times while the pump is on to estimate the volume of fluid in the wellbore. In some implementations, these volume estimates are similar to the volume estimates of step 412 in FIG. 4A. In some implementations, volume estimates 908 are taken at regular intervals after the pumps are turned on, such as every 30 seconds, every minute, every five minutes, or at other intervals. The volume estimates 908 may be analyzed by the kick detection system to determine whether a kick is occurring or not.

In some implementations, each volume estimate 908 is compared to a number of previous volume estimates to determine if a kick is occurring. In some implementations, each volume estimate 908 is compared to five previous estimates. In other implementations, four, six, seven, ten, or other numbers of previous estimates are used for the comparison. Normal curves 910 are represented on the graph 900 and may show the normal estimated volume of fluid in the wellbore over time. Although there may be some variation in the estimated volume levels of the fluid over time, the normal curves 910 include an asymptotical region where the estimated volume remains constant over time. In some implementations, the estimated volume of several normal curves 910 is averaged by the kick detection system to determine an average curve 914. In some implementations, the average curve 914 is determined by averaging five or more previous normal curves 910. This average curve 914 may then be compared to subsequent curves to determine if they are a kick curve 912. In some implementations, a kick curve 912 (representing the presence of a kick) does not reach a point where the estimated volume remains constant. Instead, the estimated volume of the kick curve 912 continues to increase over time. The kick detection system may determine that a kick is occurring if a kick curve 912 is measured to be several standard deviations above the average curve 914. If a kick curve is measured by the kick detection system, the kick detection system may prompt a controller to perform a flow check and close BOPs, if necessary.

FIG. 5 is a flow chart showing a method 500 of detecting a kick during a pumps on operation on a drilling rig. In some implementations, a pumps on operation may be a circulation or drilling operation on the drilling rig that involve the use of pumps. It is understood that additional steps may be provided before, during, and after the steps of method 500, and that some of the steps described may be replaced or eliminated for other implementations of the method 500. In particular, method 500 may continue with the steps of method 500. In particular, any of the control systems disclosed herein, including those of FIGS. 1 and 2 may be used to carry out the method 500. In some implementations, method 500 may be performed at the same time as other methods, such as at the same time as during method 400. In particular, drilling operations may include a circulating component, such as driving fluid into the wellbore at the same time that the drill bit turns.

At step 502, the method 500 may include performing a pumps on operation on a drilling rig. This step may include using one or more pumps to pump fluid in or out of the wellbore.

At step 504, a controller may determine that pumps are on and that the drill bit is drilling within a specified distance from the bottom of the wellbore. This distance may vary according to the type of drilling operation, the type of drilling rig, formation composition, and other factors. In some implementations, the specified distance is 400 feet between the drill bit and the bottom of the wellbore. If this is the case, the method 500 proceeds to step 506 and pump pressure is analyzed to determine if there is an increase of pressure indicative of a kick. If the pumps are not on or the drill bit is not within the specified distance from the bottom of the well bore, the circulation operation continues until these criteria are met. In this case, the method 500 may include analyzing pump pressure, WOB measurements, and ROP measurements to identify a kick.

At step 506, the controller may determine a baseline and a standard deviation of data points on a data channel. The data points may represent a measurement at a certain time on a certain data channel. The drilling rig may include any number of data channels for measuring data points. In some implementations, the data channels include data gathered from various sensors on the drilling rig, including return flow volume, pump pressure, WOB, ROP, etc. In some implementations, each sensor on the drilling rig is represented by a data channel. The baseline may represent a mean value of the data points measured over a certain time period. The number of data points may be chosen to achieve a balance between sample size and quick detection of changes. In some implementations, seven data points are used to calculate the baseline and the standard deviation. Although seven data points will be used throughout the discussion of method 500 as an example, other numbers of data points are possible, including, for example and without limitation, 3, 5, 8, or 10 data points. In some implementations, the step 506 includes determining the baseline and standard deviation of a number of previous data points (such as seven previous data points) as well as a current data point.

At step 510, the controller may determine if the baseline and the standard deviation of the last seven data points is greater than these values from the previous time index. If this is not the case, the method 500 continues to step 520. If this is the case, the method 500 proceeds to step 512.

At step 512, the controller may assign an initial baseline value. In some implementations, the initial baseline value is kept in a memory, for example in the controller. The initial baseline value may serve as an indication of a trend in estimated volume and may help to show when changes occur in the estimated volume. At step 514, a flagging threshold is determined. In some implementations, this flagging threshold depends on the difference between the newly assigned or previously existing initial baseline value in step 512 and the previous baseline value. For example, if the current baseline value for flow is six points (or other) higher than the previous initial baseline value for flow, the channel may be flagged. Other flagging thresholds may include ratio factors ranging from 1.025 to 2, as well as other values.

At step 516, the controller may flag a channel above the flagging threshold. Flagging a channel may include assigning a severity index value, such as 20, for example. Other implementations may assign a higher or lower severity index value.

At step 518, the controller may reset the counter and proceeding to the next time index. After step 518, the method 500 may proceed to step 532 shown in FIG. 6.

Going back to step 520, the method 500 may include determining if the baseline and the standard deviation at the current time index are greater than the baseline and standard deviation at the previous time index. If this is not the case, the method 500 continues to measure data points in step 506. If this is the case, the method 500 proceeds to step 522.

At step 522, the controller may determine how many times the baseline of the current data point is greater than the baseline of the seven previous data points.

At step 524, the controller may determine a flagging threshold, and at step 526, a channel above the threshold may be flagged.

At step 528, the controller may set the initial baseline to the current baseline.

At step 530, if the count from step 522 is high enough, the channel may be unflagged by the controller and the method 500 may proceed to the next time index. In some cases, the channel may be unflagged if the count is above 3, 4, 5, or other numbers. After step 518, the method 500 may proceed to step 532, as shown in FIG. 6.

FIG. 6 is a flow chart showing additional steps of the method 500. At step 532, the controller may access a list of flags for the data channels.

At step 534, the controller may determine if a channel is flagged for an increase in a value. Since different data channels may be used, this value may vary between channels. In some implementations, the value measured in strokes per minute (SPM or stroke counter). If the channel is flagged for an increase, the method 500 may proceed to step 536 where other flags are ignored and the method 500 proceeds to the next time index. If the channel is not flagged for an increase, the method 500 may proceed to step 538. In some implementations, all other flags are only ignored if the SPM/Flow In/Stroke counter variable was flagged for increase.

At step 538, the controller may determine if the return flow channel is flagged for an increase. If not, the method 500 may proceed to step 536 where other flags are ignored and the method 500 proceeds to the next time index. If so, the method 500 may proceed to step 540.

At step 540, the controller may determine if the return flow channel has been previously flagged. If so, the severity index is set to a value of 40 and 20 is added for every flagged data channel in step 544 which are ROP, WOB and pump pressure.

At step 546, the method 500 may proceed to the next time index. In some implementations, if there is a drop in return flow without a drop in SPM, and the current severity index is non-zero, the method 500 may include setting the severity index to zero.

In an exemplary implementation within the scope of the present disclosure, methods 500 may repeat, such that after step 542, step 544, or step 546, the method flow goes back to step 502 and begins again. Iteration of the method 500 may be utilized to update the severity index throughout a drilling operation.

FIG. 7 is a flow chart showing a method 700 of detecting a kick during a "tripping out" operation on a drilling rig. It is understood that additional steps may be provided before, during, and after the steps of method 700, and that some of the steps described may be replaced or eliminated for other implementations of the method 700.

At step 702, the method 700 may include performing a tripping out operation on a drilling rig. Tripping out may refer to pulling the drill string out of the wellbore.

At step 704, the controller may determine that the pumps are off and that the bit is far from the bottom of the wellbore. In some implementations, the bit should be more than 100 feet from the wellbore. In other implementations, the distance of the bit from the wellbore can have different measurements.

At step 706, the controller may receive measured data indicative of the flow back rate during a tripping out operation and may compare the measured flow back rate to previously measured flow back rates. In some implementations, the flow back rate is measured at regular intervals on the wellbore. Additionally, or alternatively, the flow back rate of the wellbore may be measured after various operations, such as after every drilling connection is completed.

At step 710, the controller may determine if the measured flow back rate is one standard deviation over the mean of the last five flow back rates. Again, the standard deviation of one and the mean of the last five flow back rates are used as examples only. Other implementations may use different deviations or a different number of flow back rates to establish a mean. If this is not the case, the method 700 continues at step 706. If this is the case, the method 700 continues to step 712.

At step 712, the controller may determine if the time required to remove at least two of the last five stands or joints was as long as the time required to drill the current stand. In other implementations, other number of stands or joints may be used, such as one, three, five, etc. As discussed above, the length of the time required to remove a stand or joint may impact the volume and flow rate of fluid issuing from the wellbore. If this is not the case, the method 700 continues at step 715. If this is the case, the method 700 continues to step 714.

At step 715, the controller may determine if there is an increase in return flow. If this is the case, the method 700 may proceed to step 716. If this is not the case, the method 700 may proceed to step 706.

At step 714, the controller may determine whether the current stand is already flagged. If this is not the case, the method 700 may proceed to step 716, where the stand is flagged as a potential kick. After the stand is flagged (and after the connection is completed), the measured flow rate may be stored by the controller and the oldest flow back rate (of the five previous rates) may be erased in step 718. The method 700 may then proceed to the next time index at step 720.

If the current stand is determined to be flagged at step 714, the method may proceed to step 722 where the measured flow rate is stored by the controller and the oldest flow rate is erased. The method 700 may then proceed to the next time index at step 724.

In an exemplary implementation within the scope of the present disclosure, the method 700 repeats after step 720 or step 724, such that method flow goes back to step 706 and begins again. Iteration of the method 700 may be utilized to update the severity index throughout a drilling operation.

FIG. 8 is a flow chart showing a method 800 of detecting a kick during a "tripping in" operation on a drilling rig. It is understood that additional steps may be provided before, during, and after the steps of method 800, and that some of the steps described may be replaced or eliminated for other implementations of the method 800.

At step 802, the method 800 may include performing a tripping in operation on a drilling rig. Tripping in may refer to putting the drill string into the wellbore.

At step 804, the controller may measure a volume of a trip tank. A trip tank may be connected to a pump during tripping operations, such as the one or more pumps 180 referred to in FIG. 1. The trip tank may receive fluid from the wellbore as a tripping operation is conducted.

At step 806, the controller may determine whether the change in the volume of the trip tank is greater than the average volume of the trip tank for the five stands. If this is the case, the controller may increase the severity index in step 808. In the example shown, the severity index is increased by 20. However, the severity index may be increased by any amount. If at 806, the change in the trip tank volume is not greater than the average of the last 5 stands, the severity index is decreased at step 810. In the example shown, the severity index is decreased by 20. However, the severity index may be decreased by any amount.

In an exemplary implementation within the scope of the present disclosure, the method 800 repeats after step 808 or step 810, such that method flow goes back to step 804 and begins again. Iteration of the method 800 may be utilized to update the severity index throughout the drilling operation.

In view of all of the above and the figures, one of ordinary skill in the art will readily recognize that the present disclosure introduces a drilling apparatus including: a sensor system connected to a drilling rig and configured to detect one or more measurable parameters of the drilling rig; a blow-out preventer; and a kick detection system configured to receive the one or more measurable parameters from the sensor system during a drilling operation, the kick detection system further configured to: calculate a severity index value corresponding to a likelihood of a kick based on the received measurable parameters from the sensor system; compare the severity index value to a threshold value; and close the blow-out preventer when the severity index value exceeds the threshold value.

In some implementations, the kick detection system prompts an operator to perform a flow check on the drilling apparatus if the severity index value reaches the threshold value prior to closing the blow-out preventer. In some implementations, the kick detection system is configured to prompt an operator to close the blow-out preventer if the flow check indicates a kick is occurring, and wherein the kick detection system closes the blow-out preventer only after receiving an input from the operator.

In some implementations, the kick detection system is further configured to send prompts to an operator via a display device. The first sensor system may include one or more of a flow paddle and a stroke counter. The drilling operation may be one of a drilling connection, a pumping operation, a tripping operation, casing running, or an operation where a drilling bit is on surface. In some implementations, the drilling apparatus further comprises one or more pumps and a drilling bit, wherein the kick detection system is configured to calculate the severity index value when the one or more pumps are turned on, when the one or more pumps are turned off, and when the drilling bit is on surface. The drilling apparatus may further include a drawworks, one or more pumps, and a top drive, and performing the flow check may include actuating the drawworks, shutting off the one or more pumps, and stopping a rotation of the top drive.

A method of detecting a kick on a drilling apparatus is provided, including: measuring one or more parameters of a drilling apparatus with a sensor system during a drilling operation; receiving the one or more parameters at a controller; calculating, with the controller, a severity index value corresponding to a likelihood of a kick; performing a flow check if the severity index value reaches a threshold; and automatically closing a blow-out preventer if the flow check indicates a kick is occurring.

In some implementations, the first sensor system includes one or more flow sensors. The drilling operation may be one of a drilling connection, a pumping operation, a tripping operation, casing running, or an operation where a drilling bit is on surface. The method may also include performing an automated flow check if the severity index value reaches a threshold. The method may include automatically closing the blow-out preventer if the flow check indicates a kick is occurring.

In some implementations, the method includes sending prompts to an operator or a remote operations or command center via a display device. The severity index value may be a number between 0 and 100 based on measurements during the drilling operation, wherein 100 is the highest probability of a kick occurring. The specified threshold may be 80.

An apparatus for detecting a kick on a drilling rig is provided, including: a sensor system connected to the drilling rig; and a controller in communication with the sensor system, configured to: receive measurements from the sensor system during a drilling operation; analyze the measurements from the sensor system to produce a severity index value corresponding to a likelihood of a kick; and execute operations if the severity index value reaches a threshold, the operations comprising: sending a prompt to an operator to perform a flow check; and sending a prompt to the operator to close a blow-out preventer if the flow check indicates a kick is occurring.

In some implementations, the sensor system includes one or more of a flow paddle and a stroke counter. The drilling operation may be one of a drilling connection, a pumping operation, a tripping operation, casing running, or an operation with a drilling bit on surface. The kick detection system may be further configured to perform an automated flow check if the severity index value reaches the threshold.

The foregoing outlines features of several implementations so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the implementations introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112(f) for any limitations of any of the claims herein, except for those in which the claim expressly uses the word "means" together with an associated function.

What is claimed is:

1. A drilling apparatus comprising:

a sensor system connected to a drilling rig and configured to detect one or more measurable parameters of the drilling rig;

a blow-out preventer; and a kick detection system configured to receive the one or more measurable parameters from the sensor system during a drilling operation, the kick detection system further configured to:

receive, from a display in communication with the kick detection system, a threshold value of a severity index corresponding to a likelihood of a kick;

store received measurable parameters from the sensor system including volume measurements;

average the received volume measurements from the sensor system;

calculate a severity index value based on the averaged received volume measurements from the sensor system;

compare the severity index value to the threshold value;

if the calculated severity index reaches the threshold value, perform a flow check; and close the blow-out preventer if the flow check indicates a kick is occurring.

2. The drilling apparatus of claim 1, wherein the kick detection system is configured to prompt an operator to perform the flow check on the drilling apparatus if the severity index value reaches the threshold value prior to closing the blow-out preventer.

3. The drilling apparatus of claim 2, wherein the kick detection system is configured to prompt an operator to close the blow-out preventer if the flow check indicates a kick is occurring, and wherein the kick detection system closes the blow-out preventer only after receiving an input from the operator.

4. The drilling apparatus of claim 3, wherein the kick detection system is further configured to send prompts to an operator via a display device.

5. The drilling apparatus of claim 2, wherein the drilling apparatus further comprises a drawworks, one or more pumps, and a top drive, wherein performing the flow check comprises actuating the drawworks, shutting off the one or more pumps, and stopping a rotation of the top drive.

6. The drilling apparatus of claim 1, wherein the sensor system comprises one or more of a flow paddle and a stroke counter.

7. The drilling apparatus of claim 1, wherein the drilling operation is one of a drilling connection, a pumping operation, a tripping operation, casing running, or an operation where a drilling bit is on surface.

8. The drilling apparatus of claim 1, wherein the drilling apparatus further comprises one or more pumps and a drilling bit, wherein the kick detection system is configured to calculate the severity index value when the one or more pumps are turned on, when the one or more pumps are turned off, and when the drilling bit is on surface.

9. A method of detecting a kick on a drilling apparatus, comprising:

measuring one or more parameters of a drilling apparatus with a sensor system during a drilling operation;

receiving the one or more parameters at a controller;

inputting, with a display in communication with the controller, a threshold value of a severity index corresponding to a likelihood of a kick;

calculating, with the controller, a severity index value based on the received one or more parameters;

comparing, with the controller, the threshold value and the calculated severity index value;

if the calculated severity index value reaches the threshold value, performing a flow check; and automatically closing a blow-out preventer if the flow check indicates a kick is occurring.

10. The method of claim 9, wherein the sensor system comprises one or more flow sensors.

11. The method of claim 9, wherein the drilling operation is one of a drilling connection, a circulating operation, a tripping operation, casing running, or an operation where a drilling bit is on surface.

12. The method of claim 9, further comprising performing an automated flow check if the severity index value reaches the threshold value.

13. The method of claim 9, further comprising automatically closing the blow-out preventer if the flow check indicates a kick is occurring.

14. The method of claim 9, further comprising sending prompts to an operator or a remote operations or command center via a display device.

15. The method of claim 9, wherein the severity index value is a number between 0 and 100 based on measurements during the drilling operation, wherein 100 is the highest probability of a kick occurring.

16. The method of claim 15, wherein the threshold value is 80.

17. An apparatus for detecting a kick on a drilling rig, comprising:

a sensor system comprising a plurality of sensors connected to the drilling rig with a plurality of data channels associated with the plurality of sensors; and a controller in communication with the sensor system, configured to:

receive measurements from the sensor system during a drilling operation, wherein each of the plurality of data channel carries data associated with one of the plurality of sensors;

analyze the received measurements from the sensor system and flag each channel exhibiting abnormal measurements;

determine whether a kick is likely to occur on the drilling rig based on a number of flagged channels; and execute operations if a kick is likely to occur, the operations comprising:

sending a prompt to an operator to perform a flow check; and sending a prompt to the operator to close a blow-out preventer if the flow check indicates a kick is occurring.

18. The apparatus of claim 17, wherein the sensor system comprises one or more of a flow paddle and a stroke counter.

19. The apparatus of claim 17, wherein the drilling operation is one of a drilling connection, a pumping operation, a tripping operation, casing running, or an operation with a drilling bit on surface.

20. The apparatus of claim 17, wherein the controller is further configured to perform an automated flow check if a kick is likely to occur.

* * * * *